US009719753B2

(12) United States Patent
Parsons

(10) Patent No.: US 9,719,753 B2
(45) Date of Patent: Aug. 1, 2017

(54) BATON WITH EXTERNAL CONTROL BUTTON

(71) Applicant: Armament Systems and Procedures, Inc., Appleton, WI (US)

(72) Inventor: Kevin Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 770 days.

(21) Appl. No.: 13/955,842

(22) Filed: Jul. 31, 2013

(65) Prior Publication Data

US 2015/0038240 A1 Feb. 5, 2015

(51) Int. Cl.
*F41B 15/02* (2006.01)

(52) U.S. Cl.
CPC ..... *F41B 15/027* (2013.01)

(58) Field of Classification Search
CPC ..... F41B 15/02
USPC ..... 463/47.2, 47.7; 135/75; 15/144.4
See application file for complete search history.

(56) References Cited

U.S. PATENT DOCUMENTS

| | | | | | |
|---|---|---|---|---|---|
| 2,757,002 | A | | 7/1956 | Ryden | |
| 4,037,839 | A | * | 7/1977 | Nelson | 463/47.7 |
| 4,132,409 | A | * | 1/1979 | Taylor | 463/47.6 |
| 4,135,719 | A | * | 1/1979 | Braunhut | 463/47.7 |
| 4,456,255 | A | * | 6/1984 | Braunhut | 463/47.7 |
| 4,522,398 | A | * | 6/1985 | Swartz et al. | 463/47.2 |
| 4,657,986 | A | | 4/1987 | Isayama et al. | |
| 4,703,932 | A | * | 11/1987 | Kubota | 463/47.6 |
| 4,982,960 | A | * | 1/1991 | David | 463/47.6 |
| 5,031,827 | A | * | 7/1991 | von Braunhut | 231/3 |
| 5,085,433 | A | * | 2/1992 | Parsons | 463/47.6 |
| 5,108,097 | A | * | 4/1992 | Ashihara | 463/47.6 |
| 5,356,139 | A | * | 10/1994 | Parsons | 463/47.7 |
| 5,372,363 | A | * | 12/1994 | Siddle | 463/47.7 |
| 5,529,300 | A | * | 6/1996 | Frazier et al. | 463/47.4 |
| 5,568,922 | A | * | 10/1996 | Siddle | 463/47.7 |
| 5,647,591 | A | * | 7/1997 | Parsons | 463/47.4 |
| 5,690,552 | A | * | 11/1997 | Siddle | 463/47.7 |
| 5,868,621 | A | | 2/1999 | Parsons | |
| 5,947,352 | A | * | 9/1999 | Parsons | 224/250 |
| 5,965,839 | A | * | 10/1999 | Vasel et al. | 102/502 |
| 6,026,990 | A | * | 2/2000 | Brunswig | 222/153.13 |
| 6,070,987 | A | * | 6/2000 | Jarvik | 362/84 |
| H001947 | H | * | 3/2001 | Starrett | 463/47.7 |
| 6,223,441 | B1 | * | 5/2001 | Parsons | 30/367 |

(Continued)

*Primary Examiner* — William Pierce
(74) *Attorney, Agent, or Firm* — Hahn Loeser & Parks, LLP

(57) ABSTRACT

An apparatus including a plurality of coaxially nesting tubes, a stowed position and extended position, a respective spring-loaded retainer located on a first end of at least some of the tubes, an outer edge of the retainer is coupled to a control aperture that retains the outer edge coincident with an outside annular edge of the respective tube and wherein release of the control aperture causes a spring to urge the outer edge radially outwards into the recess of the second end of the next adjacent outside tube and a rod having a control button on one end and a tapered tip on the opposing end, the rod is located inside and coaxial with the tubes with the button external to the tubes, the rod disengages the control aperture during deployment thereby causing the control button to abruptly pop outwards from the end of the outer most tube.

20 Claims, 2 Drawing Sheets

(56) References Cited

U.S. PATENT DOCUMENTS

| | | | | |
|---|---|---|---|---|
| 6,231,447 | B1 * | 5/2001 | Pelkey | 463/47.7 |
| 6,238,292 | B1 * | 5/2001 | Pelkey | 463/47.7 |
| 6,386,726 | B1 * | 5/2002 | Macierowski et al. | 362/102 |
| 6,463,688 | B1 * | 10/2002 | Idehara | 42/1.16 |
| 6,499,855 | B1 * | 12/2002 | Kukuk | 362/102 |
| 6,543,365 | B1 * | 4/2003 | Vasel et al. | 102/502 |
| 6,615,622 | B2 * | 9/2003 | MacAleese et al. | 70/16 |
| 6,761,639 | B2 * | 7/2004 | Todd | 463/47.2 |
| 7,194,960 | B2 * | 3/2007 | Vasel et al. | 102/502 |
| 7,488,255 | B2 * | 2/2009 | Labes | 463/47.7 |
| 2002/0144446 | A1 * | 10/2002 | Lindahl | 42/1.16 |
| 2005/0082321 | A1 * | 4/2005 | Macierowski et al. | 224/197 |
| 2007/0087844 | A1 * | 4/2007 | Labes | 463/47.2 |
| 2008/0078796 | A1 * | 4/2008 | Parsons | 224/668 |
| 2013/0150167 | A1 * | 6/2013 | Pelkey | 463/47.7 |

* cited by examiner

BATON WITH EXTERNAL CONTROL BUTTON

FIELD OF THE INVENTION

The field of the invention relates to police batons and more particularly to methods of quickly deploying and stowing such devices.

BACKGROUND

Batons for use by the police and military are well known. Such batons can be of great value in close quarters or where non-lethal force is necessary or warranted.

In many cases, batons used by the police or military are compact to carry and easy to deploy. In many cases, a baton may be constructed of one or more telescoping sections including a handle and more or more sections that slide into the handle. Typically, the handle is padded and the opposing end section is weighted in order to provide balance where the baton is swung and/or when the baton is used in striking an object.

A baton may be constructed from a tube forming a handle, first by swaging one end to reduce its diameter. In a second step, the weighted or intermediate section is prepared for use with the handle by flaring one end. The baton sections are assembled by inserting the respective non-flared ends into the non-swaged end of the handle or intermediate section.

The baton may be deployed by grasping the non-swaged end of the handle and flicking the other, swaged end away from the user. The flicking causes the weighted end and any intermediate sections to be flung outwards from the handle. The extension movement from the handle stops when the flared end of the weighted end and any intermediate section encounters (and locks into) the swaged end of the handle.

The baton may be stowed by grasping the handle and striking the tip of the weighted end axially on a hard surface to dislodge the flared end from the swaged end and to allow the telescoping to be reversed. However, it is often difficult to stow a baton once it has been deployed. In some cases, the tip may need to be struck against the hard surface several times to dislodge the swaged end from the flared ends.

In many cases, it is inconvenient for a police officer or soldier to stow a deployed baton. For example, if a suspect flees, the officer or soldier may not have time to find a hard surface to strike the end against. Alternatively, the noise of striking of the baton against a hard surface may alert other suspects in the area to the presence of police or military personnel. Accordingly, a need exists for better methods of constructing and using batons.

DETAILED DESCRIPTION OF AN ILLUSTRATED EMBODIMENT

Figure 1B:
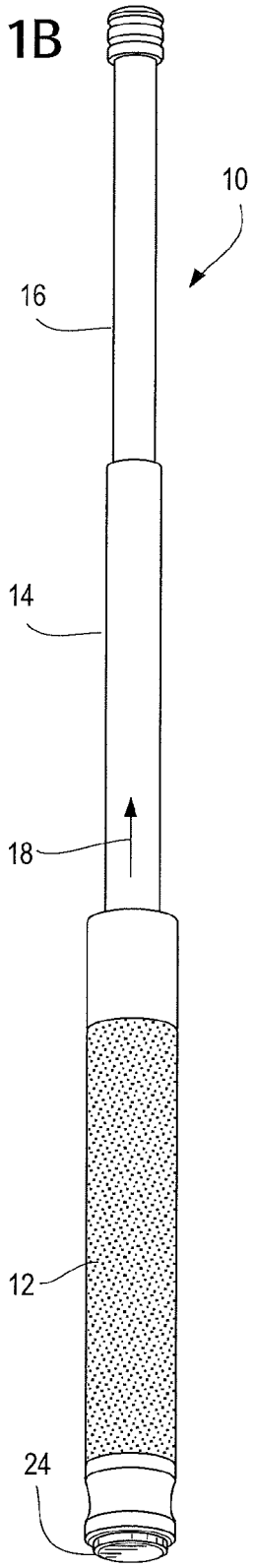
FIGS. 1A-B show an baton under an illustrated embodiment in both stowed and deployed positions.

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

Figure 1A:
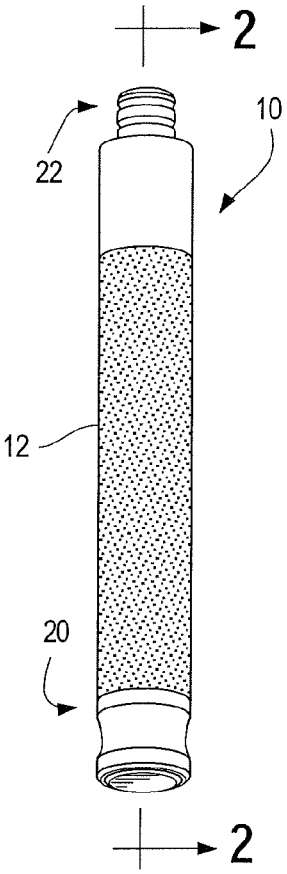

FIGS. 1A-B is a side view of a police or military baton 10 shown generally in accordance with an illustrated embodiment. FIG. 1A shows the baton 10 in a retracted or stowed position and FIG. 1B shows the baton in an extended position ready for use against an adversary.

In general, the baton is constructed of a one or more tubes 12, 14 and a weighted distal end 16. In a stowed position (FIG. 1A), the tubes and weighted end are coaxial and concentric with the distal end and any intermediate sections (tubes) nested inside of the handle.

In a deployed state (FIG. 1B), the handle, the weighted end and any intermediate tube 14 remain in a coaxial relationship with the inside tubes 14, 16 deployed along the predominant axis 18 of the tubes 12, 14, 16. The baton may be deployed conventionally by grasping the handle with the heel of the user's hand proximate a first end 20 and flicking the second end 22 outwards away from the user via a quick rotation of the user's wrist. Alternatively, as explained below, the user may simply push the weighted end back into the handle.

Once deployed, a respective spring loaded retainer (discussed below) locks each section 12, 14, 16 to the directly adjacent, next section. In this regard, the retainer in the end section locks the end section to the intermediate section or to the handle (if no intermediate section is used).

As the baton is deployed and each section locks to the next section, a release button 24 abruptly pops out of the handle. To stow the baton, a user simply activates the button (pushing it back into the handle) to release the string loaded retainers and then pushes the end section (and any intermediate section) back into the handle thereby returning the baton to the stowed position or state.

Figure 2:
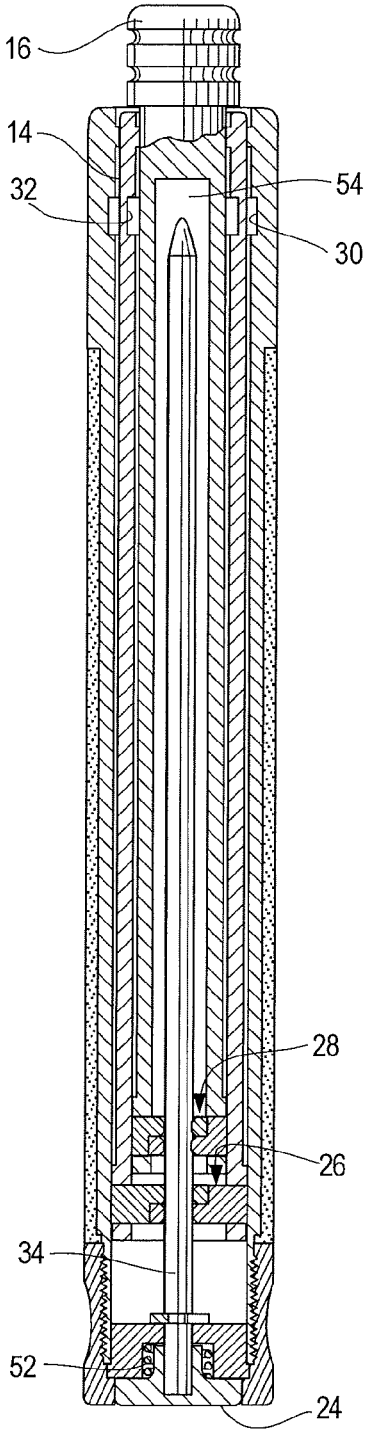
FIG. 2 shows a cut-away view of the baton of FIG. 1.

FIG. 2 is a simplified, cut-away view of the baton in a retracted state. As shown in FIG. 2, the end section and intermediate section each include a respective spring loaded retainer or lock 26, 28. In this regard, as the sections of the baton are extended to the fully deployed position, the spring loaded retainers each engage and lock into a respective recess 30, 32. In one embodiment, the recess 30, 32 is an annulus cut into the inner surface of the second end of the handle and intermediate section.

Also shown in FIG. 2 is a control rod 34. The control rod extends between the release button 24 and each of the spring loaded retainers.

Figure 3:
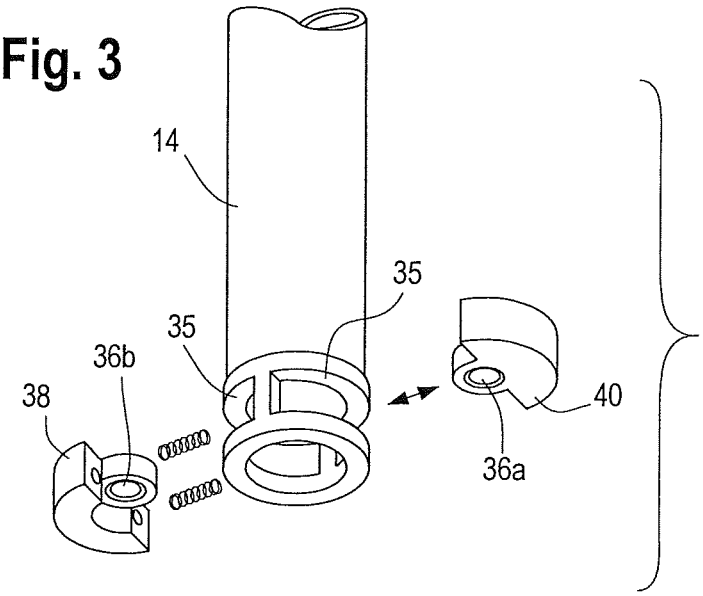
FIG. 3 depicts details of the baton of FIG. 1.

FIG. 3 is a side perspective view of the first end of the weighted end or intermediate section showing assembly details of the spring loaded retainers. As shown, respective slots 35 are cut into opposing sides of the first end of the weighted end and intermediate sections to receive portions 38, 40 of the spring loaded retainer. Once inserted into the slot, an aperture 36*a*, 36*b* secures the retainer within the slot.

Figure 4A:
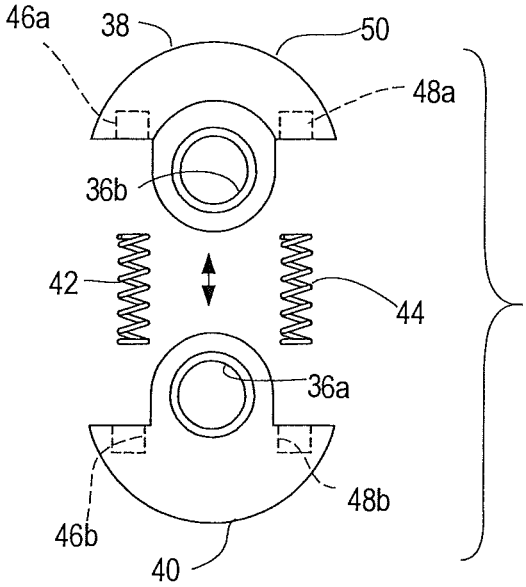
FIG. 4 shows an exploded view of a retainer or lock of the baton of FIG. 1.
Figure 4B:
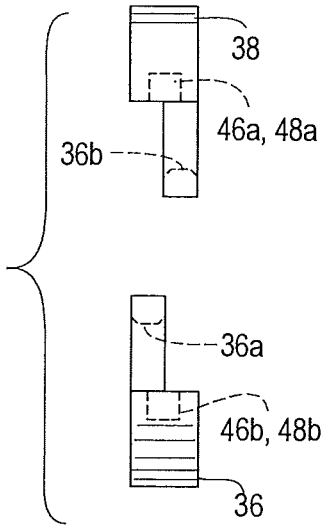

FIGS. 4A-B are exploded views of the spring retainers including a front view and a right side view. As shown in FIG. 4, each spring retainer 26, 28 includes a pair of cooperating first and second semicircular plates 38, 40 and first and second springs 42, 44.

Included within the semicircular plates are a set of spring apertures 46*a*, 46*b*, 48*a*, 48*b* that receive the respective ends of the springs 42, 44. During use, the control rod extends through apertures 36*a*, 36*b* thereby holding the apertures 36*a*, 36*b* in coaxial alignment with the tubes and the springs of each spring loaded retainer in compression. So long as the control rod extends through both apertures, an outer edge 50 of the spring retainer 26, 28 is held even with (or slightly below) an outer circumference (outside annular edge) of the respective sections 14, 16. When the control rod is withdrawn from the apertures, the springs urge the semicircular plates outwards and into the recesses 30, 32, thereby locking each inside section of the baton to the next closest outer section that is directly adjacent the inside section.

As the semicircular plates move radially outwards, the apertures 36*a*, 36*b* are no longer in axial alignment with the tubes. However, even with the semicircular plates extended, the predominant axis 18 of the tubes still passes through the apertures 36*a*, 36*b*, albeit off center. This allows a tapered end 54 of the control rod to later re-engage and retract the semicircular plates.

In order to deploy the baton, a user may grasp the handle on one end and the knob on the distal end of the weight section (the knob is shown in the far right side of FIG. 2) and pull outwards. The outwards force may first cause the weighted section to begin sliding outwards relative to the intermediate section and handle. Since the control rod is attached to the handle, the outward movement of the weighted section causes the control rod to be withdrawn from the apertures 36*a*, 36*b* of the retainer 28. Immediately before the retainer 28 reaches the recess 32, the control rod exits the apertures 36*a*, 36*b* of the retainer 28. This allows the springs to push the semicircular plates outwards into the recess 32, thereby locking the first end of the weighted section to the second end of the intermediate section.

If the user continues to pull, the locked weighted section and intermediate section causes the intermediate section to begin moving outwards away from the handle. As the intermediate section moves outwards, the control rod is withdrawn from the retainer 26 of the intermediate section. Immediately before the retainer 26 reaches the recess 30, the control rod exits the apertures 36*a*, 36*b* of the retainer of the intermediate section. This allows the springs of the retainer 26 to push the semicircular plates into the recess 30, thereby, locking the intermediate section to the handle.

As the intermediate section locks to the handle, the release button 24 abruptly pops out of the end of the handle. In this regard, as the control rod exits the retainer 26, a control rod spring 52 (FIG. 2) pushes the button outwards at the same instant as the baton locks in the fully deployed state.

In order to stow the baton, the user may first activate the release button and then push the weighted end into the handle. Activating the release button causes the control rod to re-enter and align the apertures 36*a*, 36*b* of the retainer 26, thereby, releasing the retainer. More specifically, a tapered distal end of the control rod enters the apertures contacting each of the apertures along one edge on opposing sides. As the tapered end enters the apertures, the sliding contact on the opposing sides with the taper pushes the apertures into alignment by forcing the semicircular plates inwards thereby realigning the first aperture 36*a* with the second aperture 36*b* and with the control rod thereby retracting the semicircular plates and releasing the retainer 26.

The release button and locking retainers offer significant advantage over prior batons. In this case, the user may slowly pull the seconds outwards from the position shown in FIG. 1A to the position shown in FIG. 1B. As the user pulls the sections outwards, the user feels a soft click as the retainers lock the sections into the extended position and the control button pops out of the handle.

Once deployed, the user no longer has to strike the end of the baton on a hard surface to stow the extended sections into the handle. Instead, the user simply pushes the control button back into the handle, thereby releasing the retainers. Once the retainers have been released via the control button, the user is able to easily push the inside sections back into the handle.

In general, the baton includes a plurality of coaxially nested tubes, each having a first end and a second end with a recess on an inside surface of some of the second ends, the plurality of tubes having a stowed position where the first ends are adjacent and an extended position where the first end of an inside tube is directly adjacent the second end of the next adjacent outside tube, a respective spring-loaded retainer located on a first end of each of at least some of the plurality of nested tubes, each respective retainer having an outer edge coupled to a control aperture wherein the control aperture operates to retain the outer edge coincident with an outside annular edge of the respective tube in a retracted position and wherein release of the control aperture causes a spring of the retainer to urge the outer edge radially outwards into the recess of the second end of the next adjacent outside tube and a control rod having a button on one end and a tapered tip on the opposing end, the control rod is located inside and is also coaxial with the coaxially nested tubes with a marginal end of the control rod and button coincident with an outside marginal annular edge on the first end of an outer most of the plurality of tubes, the control rod engages the control aperture of each of the at least some tubes in the stowed position to retain the outer edge of the respective retainers in the retracted position and as the plurality of tubes are extended, the tapered end of the control rod disengages the control aperture thereby causing the button to abruptly pop outwards from the marginal edge of the outer most tube.

In another illustrated embodiment, the baton includes a plurality of coaxially nested tubes, a respective spring-loaded retainer located on a first end of at least one of the plurality of nested tubes, the retainer having an outer edge coupled to a control aperture wherein the control aperture operates to retain the outer edge coincident with an outside annular edge of the at least one tube in a retracted position of the plurality of tubes and wherein release of the control aperture causes a spring of the retainer to urge the outer edge radially outwards and to lock into the recess of a second end of the next adjacent outside tube and a control rod having a button on one end that is located inside and is also coaxial with the coaxially nested tubes with a marginal end of the control rod and button coincident with and secured to an outside marginal annular edge on a first end of an outer most of the plurality of tubes, the control rod engages the control aperture of the at least one tube in a stowed position of the plurality of tubes to retain the outer edge of the retainer in the retracted position and as the plurality of tubes are extended, the tapered end of the control rod disengages the control aperture thereby causing the button to abruptly pop outwards from the marginal edge of the outer most tube.

In still another illustrated embodiment, the baton includes a plurality of coaxially nested tubes each having a first and second end, the plurality of tubes having a retracted position and an extended position wherein the first ends are all adjacent in the retraced position and in the extended position, the first end of an inside tube is directly adjacent a second end of the next outer tube of the plurality of tubes, a spring-loaded lock located within a first end of at least one inside tube of the plurality of nested tubes, the radially extending lock having an outer edge that extends radially from a control aperture wherein the control aperture operates to retain the outer edge coincident with an outside annular edge of the at least one inside tube in the retracted position and wherein release of the control aperture causes a spring of the retainer to urge the outer edge radially outwards and to lock into a recess inside the second end of the next adjacent outside tube and a control rod having a button on one end, the control rod and button are located inside and are coaxial with the coaxially nested tubes with a marginal end of the control rod and button coincident with and secured to an outside marginal annular edge on the first end of an outer most of the plurality of tubes, the control rod engages the control aperture of the at least one inside tube in the retracted position to retain the outer edge of the lock in the retracted position and as the plurality of tubes are extended, the tapered end of the control rod disengages the control aperture thereby causing the button to abruptly pop outwards from the marginal edge of the outer most tube.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

a plurality of coaxially nesting tubes, each having a first end and a second end with a recess on an inside surface of some of the second ends, the plurality of tubes having a stowed position where the first ends are adjacent and an extended position where the first end of an inside tube is directly adjacent the second end of the next adjacent outside tube;

a respective spring-loaded retainer located on a first end of each of at least one of the plurality of nesting tubes, each respective retainer having an outer edge coupled to a control aperture wherein the control aperture operates to retain the outer edge coincident with an outside annular edge of the at least one tube in a retracted position of the retainer and wherein a spring of the retainer urges the outer edge radially outwards into the recess of the second end of the next adjacent outside tube; and a rod having an external control button on one end and a tapered tip on the opposing end, the rod is located inside and is also coaxial with the coaxially nesting tubes with the button external to, located on the common axis of the plurality of tubes and extends away from the plurality of tubes on the first end, the rod engages the control aperture of each of the at least one of the plurality of nesting tubes in the stowed position to retain the outer edge of the respective retainers in a retracted position and as the plurality of tubes are extended, the tapered end of the rod disengages the control aperture thereby causing the control button to abruptly pop outwards from the end of the outer most tube.

2. The apparatus as in claim 1 wherein the spring-loaded retainer further comprises a pair of semicircular plates on opposing sides of the control rod in the stowed position.

3. The apparatus as in claim 2 wherein the control aperture in the spring-loaded retainer further comprises a control aperture in each of the pair of semicircular plates.

4. The apparatus as in claim 3 wherein the pair of semicircular plates further comprise a pair of springs located between the pair of plates, perpendicular to the control rod that urge the pair of semicircular plates outwards.

5. The apparatus as in claim 4 further comprising a slot cut through the first ends of the at least some tubes, the slot receives the pair of plates inserted in a direction perpendicular to the control rod.

6. The apparatus as in claim 1 wherein the recess on the inside surface further comprises an annulus.

7. An apparatus comprising:

a plurality of coaxially nesting tubes;

a respective spring-loaded retainer located on a first end of at least one of the plurality of nested tubes, the retainer having an outer edge coupled to a control aperture wherein the control aperture operates to retain the outer edge coincident with an outside annular edge of the at least one tube in a retracted position of the retainer and wherein a spring of the retainer urges the outer edge radially outwards and to lock into the recess of a second end of the next adjacent outside tube; and a control rod having a button attached on one end, the control rod is located inside and is coaxial with the coaxially nested tubes with the control button located external to and on the common axis of the plurality of tubes, the control button extends away the plurality of tubes on the first end, the control rod engages the control aperture of the at least one tube in a stowed position of the plurality of tubes to retain the outer edge of the retainer in a retracted position and as the plurality of tubes are extended, the tapered end of the control rod disengages the control aperture thereby causing the button to abruptly pop outwards from the first end of the outer most tube.

8. The apparatus as in claim 7 further comprising a spring disposed between the outside marginal edge of the outer tube and button.

9. The apparatus as in claim 7 wherein the spring-loaded retainer further comprises a pair of semicircular plates on opposing sides of the control rod in the stowed position.

10. The apparatus as in claim 9 wherein the control aperture of the spring-loaded retainer further comprises a control aperture in each of the pair of semicircular plates.

11. The apparatus as in claim 10 wherein the pair of semicircular plates further comprise a pair of springs located between the pair of plates, perpendicular to the control rod that urge the pair of semicircular plates outwards.

12. The apparatus as in claim 11 further comprising a slot cut through the first end of the at least one tubes, the slot receives the pair of plates inserted in a direction perpendicular to the control rod.

13. The apparatus as in claim 7 wherein the recess on the inside surface further comprises an annulus.

14. An apparatus comprising:

a plurality of coaxially nested tubes each having a first and second end, the plurality of tubes having a retracted position and an extended position wherein the first ends are all adjacent in the retraced position and in the extended position, the first end of an inside tube is directly adjacent a second end of the next outer tube of the plurality of tubes;

a spring-loaded lock located within a first end of at least one inside tube of the plurality of nested tubes, the lock having an outer edge that extends radially outwards from a control aperture wherein the control aperture operates to retain the outer edge coincident with an outside annular edge of the at least one inside tube in the retracted position and wherein a spring of the retainer urges the outer edge radially outwards from the at least one inside tube and to lock into a recess inside the second end of the next adjacent outside tube; and a control rod having an external button on one end, the control rod is located inside and is coaxial with the coaxially nested tubes with the button external to and on the common axis of the plurality of tubes extending outwards from the plurality of tubes on the first end, the control rod engages the control aperture of the at least one inside tube in a retracted position to retain the outer edge of the lock in the retracted position and as the plurality of tubes are extended, the tapered end of the control rod disengages the control aperture thereby causing the button to abruptly pop outwards from the first end of the outer most tube.

15. The apparatus as in claim 14 wherein the plurality of coaxially nested tubes further comprises three.

16. The apparatus as in claim 14 wherein the spring-loaded retainer further comprises a pair of semicircular plates extending radially outwards on opposing sides of the control rod.

17. The apparatus as in claim 14 wherein each of the pair of semicircular plates further comprises a control aperture.

18. The apparatus as in claim 17 wherein the pair of semicircular plates further comprise a pair of springs located between the pair of plates, perpendicular to the control rod that urge the pair of semicircular plates outwards.

19. The apparatus as in claim 18 further comprising a slot cut through the first end of the at least one tubes, the slot receives the pair of plates inserted in a direction perpendicular to the control rod.

20. The apparatus as in claim 14 wherein the recess on the inside surface further comprises an annulus.

* * * * *